US010267336B2

(12) United States Patent
Masuda et al.

(10) Patent No.: US 10,267,336 B2
(45) Date of Patent: Apr. 23, 2019

(54) INSERTING AND REMOVING DEVICE FOR COMPRESSOR, AND METHOD OF INSERTING AND REMOVING BUNDLE

(71) Applicant: MITSUBISHI HEAVY INDUSTRIES COMPRESSOR CORPORATION, Tokyo (JP)

(72) Inventors: Yuji Masuda, Hiroshima (JP); Toru Yoshimune, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 99 days.

(21) Appl. No.: 15/541,523

(22) PCT Filed: Feb. 6, 2015

(86) PCT No.: PCT/JP2015/053402
§ 371 (c)(1),
(2) Date: Jul. 5, 2017

(87) PCT Pub. No.: WO2016/125306
PCT Pub. Date: Aug. 11, 2016

(65) Prior Publication Data

US 2017/0350418 A1 Dec. 7, 2017

(51) Int. Cl.
*B23P 19/04* (2006.01)
*F04D 29/62* (2006.01)
*F04D 17/12* (2006.01)

(52) U.S. Cl.
CPC ..... *F04D 29/624* (2013.01); *F04D 17/125* (2013.01)

(58) Field of Classification Search
CPC . F04D 29/624; F04D 17/125; B23K 37/0443; B23P 19/04; B23Q 11/02; Y10T 29/53961

(Continued)

(56) References Cited

U.S. PATENT DOCUMENTS 3,218,056 A * 11/1965 Kaplan ..... B25H 1/0007 269/17
3,970,295 A * 7/1976 Cooper ..... B23K 37/0533 269/17

(Continued)

FOREIGN PATENT DOCUMENTS

| | | | |
|---|---|---|---|
| JP | 2-72400 | U | 6/1990 |
| JP | 2012-177337 | A | 9/2012 |
| WO | WO 2014/132342 | A1 | 9/2014 |

OTHER PUBLICATIONS

International Search Report (Form PCT/ISA/210) issued in International Application No. PCT/JP2015/053402 dated May 12, 2015, with an English translation.

(Continued)

*Primary Examiner* — George B Nguyen
(74) *Attorney, Agent, or Firm* — Birch Stewart Kolasch & Birch, LLP

(57) ABSTRACT

This compressor inserting and removing device (1) is provided with: an intermediate supporting portion (4) which supports a bundle (32), prior to insertion from a horizontal axis (L1) direction into a compressor casing (34) taking the form of a tube centered around the horizontal axis (L1), from an outer peripheral side of the bundle (32), at a position that is closer to the insertion side of the bundle (32) than an end portion (32*d*) on the side opposite to the insertion side of the bundle (32); a moving portion (10) which makes it possible for the intermediate supporting portion (4) and the compressor casing (34) to move relative to one another in the horizontal axis L1 direction; a threaded rod (12) which extends parallel to the horizontal axis (L1), and which is fixed at a distal end (12*a*) thereof to a fixing hole (34*b*) formed in an end surface (34*a*) at the insertion side of the compressor casing (34), and which passes through through-holes (6*a* and 7*a*) formed in the intermediate supporting (Continued)

portion (4); and a nut (13) which is attached to the threaded rod (12), in such a way as to be capable of coming into contact with the intermediate supporting portion (4), from the side that is closer to the rear end portion (32*d*) of the bundle (32) than the intermediate supporting portion (4).

4 Claims, 17 Drawing Sheets

(58) Field of Classification Search
USPC ..... 29/281.1, 281.4; 269/17
See application file for complete search history.

(56) References Cited

U.S. PATENT DOCUMENTS 6,115,896 A * 9/2000 Gonçalves ..... B01D 29/01 29/221.6
6,491,293 B1 * 12/2002 Brewer ..... B25B 11/02 269/17
7,798,479 B1 * 9/2010 Meeks ..... H02G 15/24 254/134
8,490,955 B2 * 7/2013 Sarh ..... B21J 15/14 269/17
8,534,986 B2 * 9/2013 Borer ..... F04D 17/122 29/281.1
2008/0066519 A1 * 3/2008 Potter ..... B21D 1/12 72/372
2013/0139368 A1 * 6/2013 Iseki ..... F01D 25/285 29/281.4
2013/0266440 A1 * 10/2013 Ota ..... F04D 29/4206 415/213.1
2016/0003263 A1 * 1/2016 Yoshida ..... F04D 29/4206 29/888.024
2016/0069477 A1 * 3/2016 Tabor ..... F16L 1/06 29/559
2016/0137315 A1 * 5/2016 Noel ..... B64F 5/50 269/17

OTHER PUBLICATIONS

Written Opinion of the International Searching Authority (Form PCT/ISA/237) issued in International Application No. PCT/JP2015/053402 dated May 12, 2015, with an English translation.

* cited by examiner

INSERTING AND REMOVING DEVICE FOR COMPRESSOR, AND METHOD OF INSERTING AND REMOVING BUNDLE

TECHNICAL FIELD

The present invention relates to an inserting and removing device for a compressor and a method of inserting and removing a bundle.

BACKGROUND ART

In general, in a vertical separation type compressor, an approximately columnar bundle in which product parts such as a rotor or a stationary part are built can be inserted into the inside of a cylindrical compressor casing or can be extracted from the compressor casing.

For example, PTL 1 discloses an inserting and removing device for inserting and removing a bundle of a compressor with respect to a compressor casing. The inserting and removing device disclosed in PTL 1 includes a plate-shaped member which is attached to an end portion on a side opposite to an insertion side in an insertion direction of the bundle with respect to the compressor casing, and a puller rod which is screwed to the plate-shaped member and is inserted into a hole of the compressor casing.

CITATION LIST

Patent Literature

[PTL 1] Japanese Unexamined Patent Application Publication No. 2012-177337

SUMMARY OF INVENTION

Technical Problem

In the technology disclosed in PTL 1, the puller rod which is longer than the entire length of the bundle in the insertion direction of the bundle with respect to the compressor casing is required. An object of the present invention is to provide a small-sized inserting and removing device for a compressor and a method of inserting and removing a bundle using the same.

Solution to Problem

According to an aspect of the present invention, there is provided an inserting and removing device for a compressor, including: an intermediate supporting portion which supports a bundle before being inserted into a compressor casing formed in a tubular shape about a horizontal axis in a direction of the horizontal axis, from an outer peripheral side of the bundle at a position closer to an insertion side than an end portion on a side opposite to the insertion side of the bundle; a moving portion which can move the intermediate supporting portion and the compressor casing relative to each other in the direction of the horizontal axis; a threaded rod which extends to be parallel to the horizontal axis, has a distal end fixed to a fixing hole formed on an end surface on the insertion side of the compressor casing, and is inserted into a through-hole formed in the intermediate supporting portion; and a nut which is attached to the threaded rod so as to come into contact with the intermediate supporting portion from a side closer to the end portion of the bundle than the intermediate supporting portion.

According to the inserting and removing device for a compressor of the aspect, it is possible to use the threaded rod which is shorter than the entire length of the bundle in a direction of a center axis of the bundle in a state where the center axis of the bundle is in the direction of the horizontal axis. Accordingly, the size of the inserting and removing device for a compressor is reduced.

The inserting and removing device for a compressor of the aspect may further include an end support portion which has a through-hole which is coaxially formed with the through-hole of the intermediate supporting portion and into which the threaded rod can be inserted, and supports the end portion.

In this case, the threaded rod can be easily replaced from the intermediate supporting portion to the end support portion, and it is possible to move the bundle to a specified position inside the compressor casing using the threaded rod and the nut or it is possible to move the bundle from a specified position inside the compressor casing using the threaded rod and the nut.

The intermediate supporting portion may include a curved plate which is formed in a curved shape following a shape of an outer periphery of the bundle, a first support plate which includes the through-hole, extends in a direction orthogonal to a center axis of the through-hole, and is fixed to the curved plate, a second support plate which extends to be parallel to the first support plate at a position separated from the first support plate in the direction of the center axis of the through-hole, and has a second through-hole which is coaxially formed with the through-hole and into which the threaded rod can be inserted, a seat plate which connects the first support plate and the second support plate to each other, and a rib plate which connects the first support plate and the second support plate at a position separated from the seat plate.

In this case, since the first support plate and the second support plate are reinforced by the seat plate and the rib plate, the weight of intermediate supporting portion is reduced and rigidity thereof increases.

According to another aspect of the present invention, there is provided a method of inserting and removing a bundle, including: a step of connecting a position of an outer peripheral surface of a bundle closer to an insertion side of a bundle inserted into a compressor casing than an end portion on a side opposite to the insertion side and the compressor casing to each other by an intermediate supporting portion which supports the bundle and a threaded rod which is inserted into the intermediate supporting portion, extends in an insertion direction of the bundle with respect to the compressor casing, and can be fixed to the compressor casing; and a step of moving the bundle and the compressor casing relative to each other in the insertion direction by rotating a nut screwed to the threaded rod around a center axis of the threaded rod in a state where the nut abuts on the intermediate supporting portion.

According to the method of inserting and removing a bundle of the aspect, since it is possible to use the threaded rod which is shorter than the entire length of the bundle, it is possible to insert and remove the bundle with respect to the compressor casing in a space where the bundle and the compressor casing are arranged in the insertion direction of the bundle.

Advantageous Effects of Invention

According to the present invention, it is possible to provide a small-sized inserting and removing device for a compressor and a method of inserting and removing a bundle using the same.

DESCRIPTION OF EMBODIMENTS

An embodiment of the present invention will be described.

Figure 1:
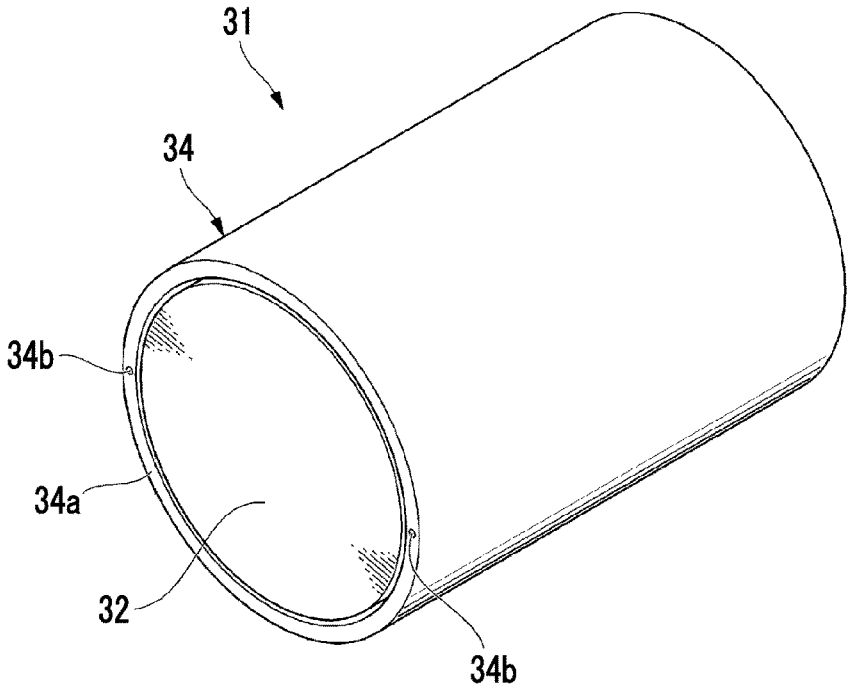
FIG. 1 is a schematic perspective view of a compressor which is assembled and disassembled by an inserting and removing device for a compressor according to an embodiment of the present invention.
Figure 2:
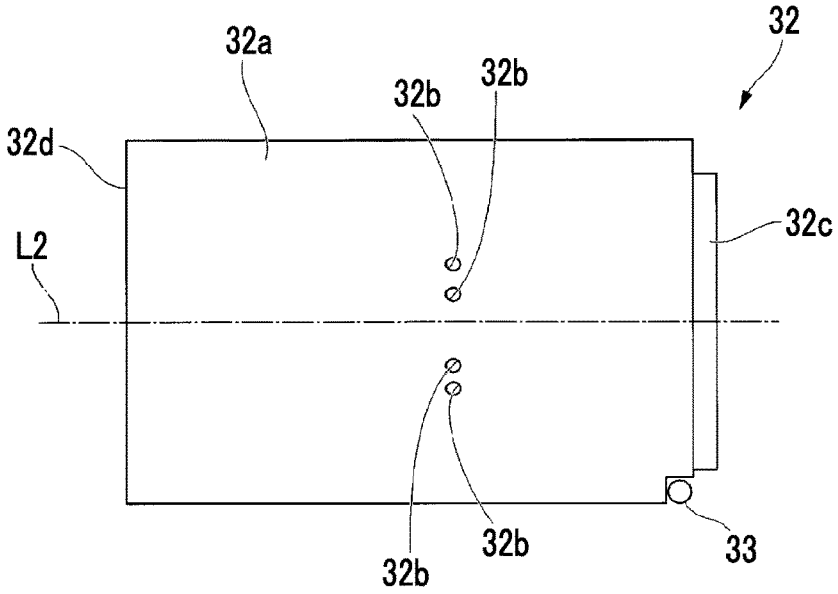
FIG. 2 is a schematic side view of a bundle of the compressor.
Figure 3:
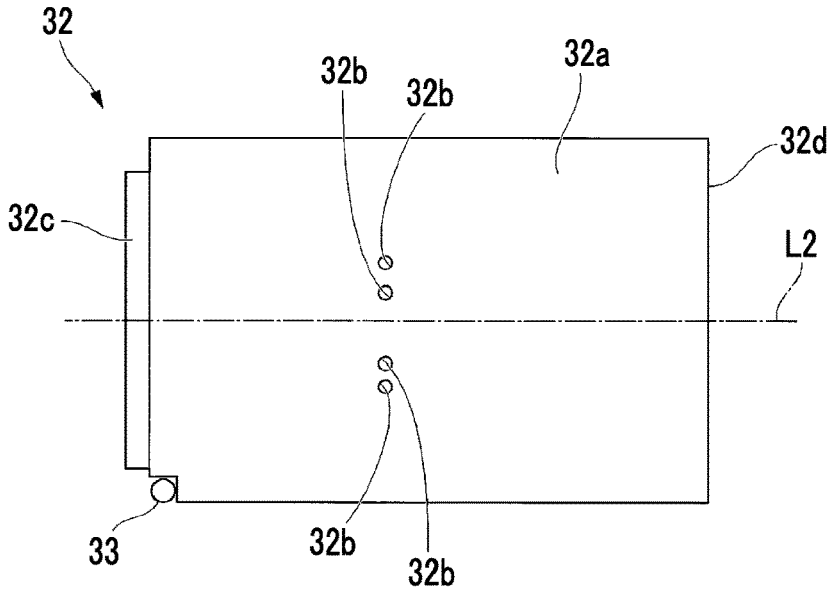
FIG. 3 is a schematic side view of the bundle.
Figure 4:
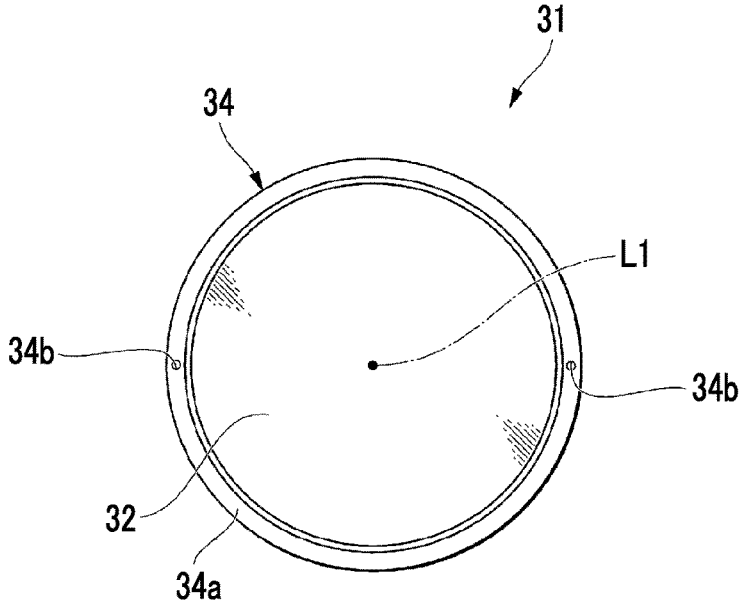
FIG. 4 is a schematic rear view of the compressor.

An inserting and removing device 1 for a compressor (hereinafter, referred to an "inserting and removing device") of the present embodiment is a device which is used so as to assemble and disassemble the compressor 31. First, a configuration of a compressor 31 which is assembled and disassembled by the inserting and removing device 1 of the present embodiment will be described. FIG. 1 is a schematic perspective view of a compressor which is assembled and disassembled by the inserting and removing device for a compressor of the present embodiment. FIG. 2 is a schematic side view of a bundle of the compressor. FIG. 3 is a schematic side view of the bundle. FIG. 4 is a schematic rear view of the compressor.

As shown in FIG. 1, the compressor 31 is a vertical division type compressor which is horizontally provided, and includes an approximately columnar bundle 32 and a compressor casing 34 (hereinafter, referred to as a "casing").

As shown in FIGS. 2 and 3, the bundle 32 is an approximately columnar member in which product parts (not shown) such as rotors or stationary parts are accommodated. Attachment holes 32*b* for attaching traveling plates 5 of the inserting and removing device 1 are provided on an outer peripheral surface 32*a* of the bundle 32.

As shown in FIGS. 2 and 3, side rollers 33 are installed downward at the two locations on the outer periphery of a distal end portion 32*c* of the bundle 32. The side rollers 33 are rollers which roll on rails 3 of a bundle stand 2 and rotate in a casing 34.

The casing 34 shown in FIGS. 1 and 4 is mounted on an upper surface of a casing stand 35 such that the axial direction of the casing 34 is horizontal and is a member which is formed in a tubular shape about a horizontal axis L1. Fixing holes 34*b* into which traveling rods 12 of the inserting and removing device 1 are inserted are formed on an end surface 34*a* of an insertion side of the casing 34 into which the bundle 32 is inserted. Each of the fixing holes 34*b* is a bottomed hole in which the center axis extends to be parallel to the horizontal axis L1 of the casing 34, and has screw grooves, to which the traveling rod 12 is screwed, inside the fixing hole 34*b*.

Figure 5:
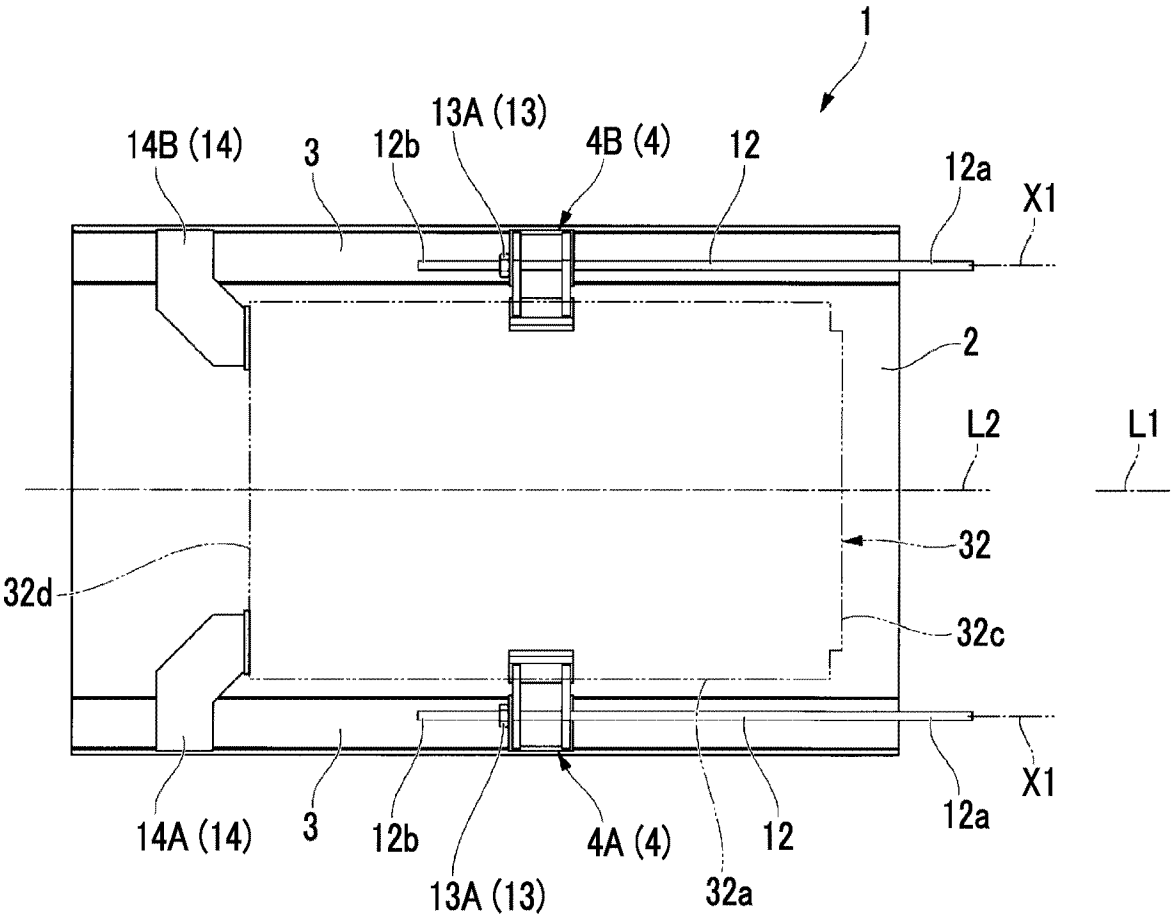
FIG. 5 is a plan view of an inserting and removing device for a compressor of the embodiment.
Figure 6:
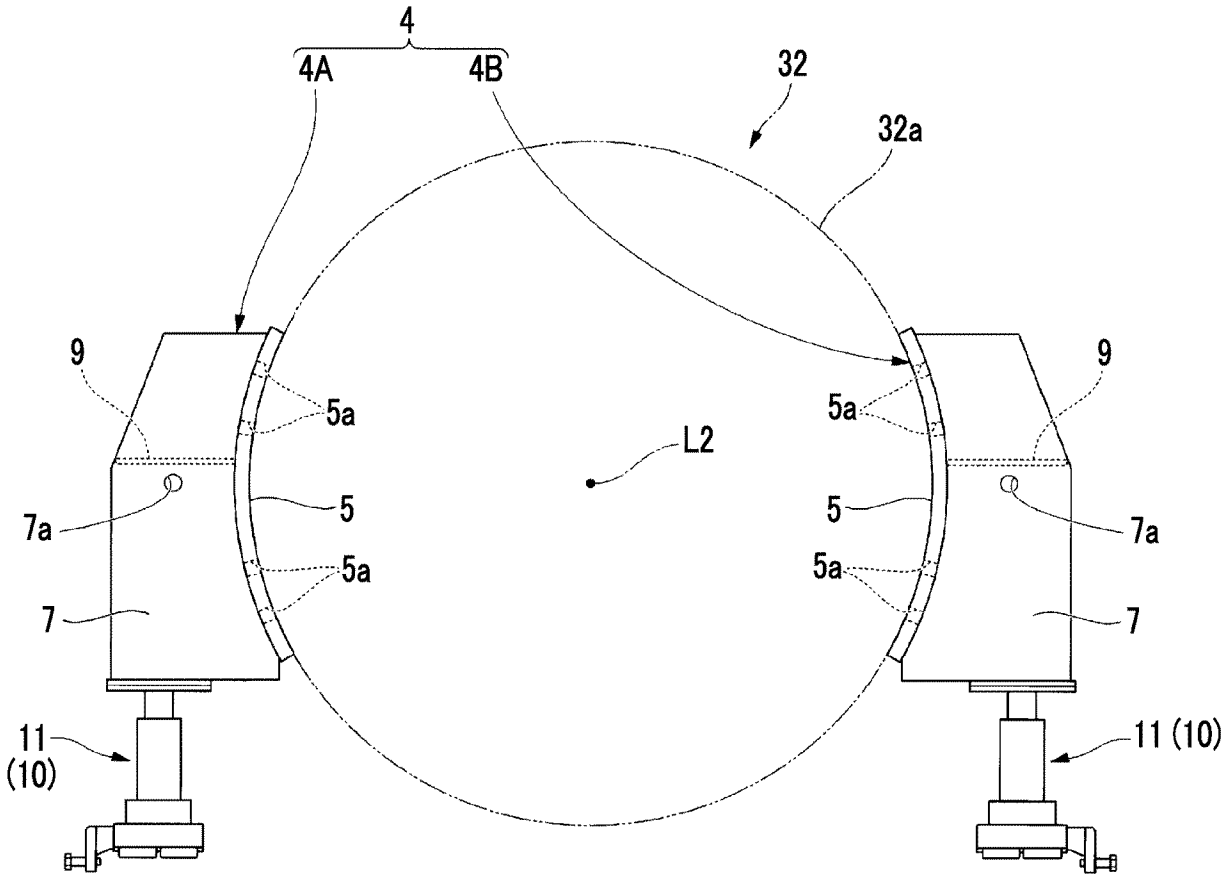
FIG. 6 is a front view of an intermediate supporting portion of the inserting and removing device for a compressor.
Figure 7:
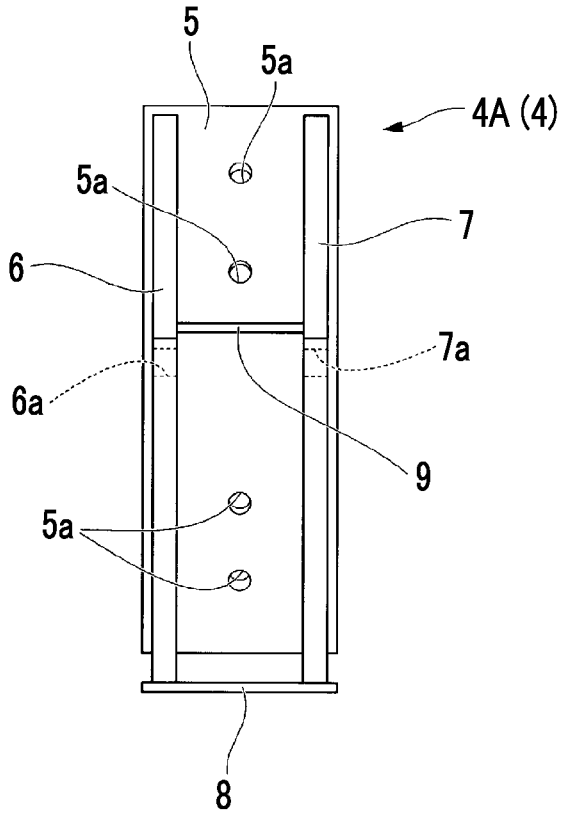
FIG. 7 is a side view of the intermediate supporting portion of the inserting and removing device for a compressor.
Figure 8:
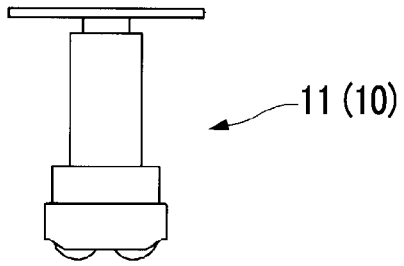
FIG. 8 is a side view showing a portion of a moving portion of the inserting and removing device for a compressor.
Figure 9:
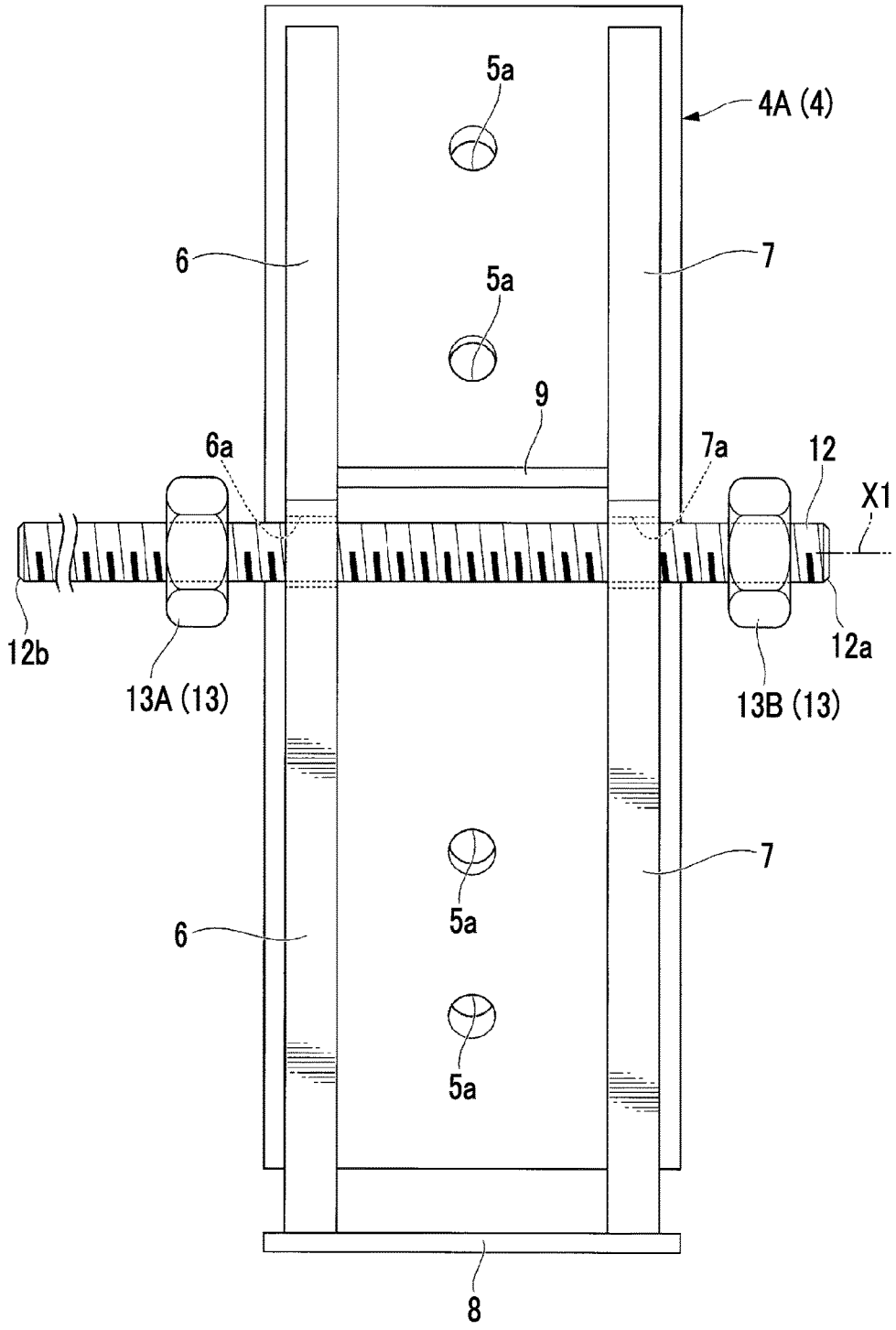
FIG. 9 is a side view showing a state where a traveling rod is attached to the intermediate supporting portion of the inserting and removing device for a compressor.
Figure 10:
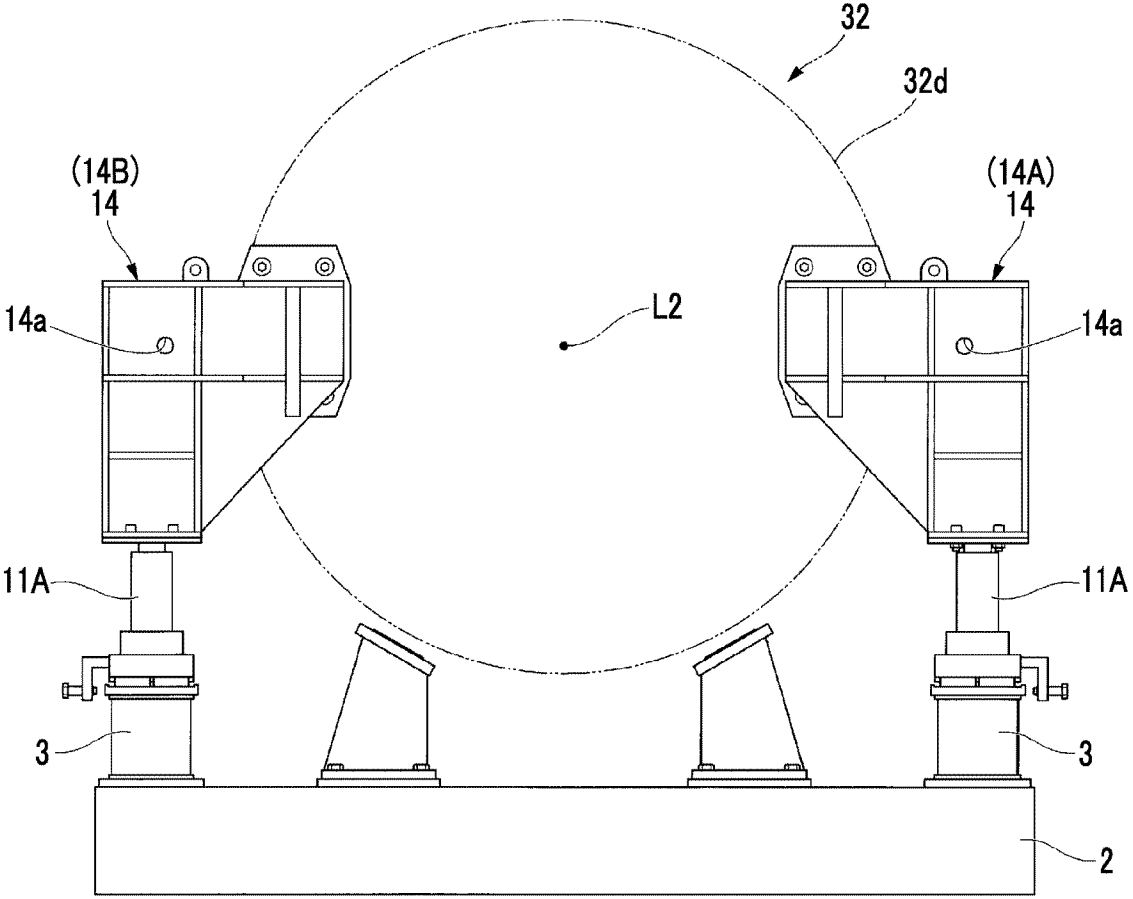
FIG. 10 is a rear view of the inserting and removing device for a compressor.

Next, the configuration of the inserting and removing device 1 of the present embodiment for inserting and removing the bundle 32 of the compressor 31 with respect to the casing 34 of the compressor 31 will be described. FIG. 5 is a plan view of the inserting and removing device for a compressor of the present embodiment. FIG. 6 is a front view of an intermediate supporting portion of the inserting and removing device for a compressor of the present embodiment. FIG. 7 is a side view of the intermediate supporting portion of the inserting and removing device for a compressor of the present embodiment. FIG. 8 is a side view showing a portion of a moving portion of the inserting and removing device for a compressor of the present embodiment. FIG. 9 is a side view showing a state where the traveling rod is attached to the intermediate supporting portion of the inserting and removing device for a compressor of the present embodiment. FIG. 10 is a rear view of the inserting and removing device for a compressor of the present embodiment.

As shown in FIG. 5, the inserting and removing device 1 includes the bundle stand 2, a pair of intermediate supporting portions 4, moving portions 10 (refer to FIG. 6), the traveling rods 12 (threaded rods), nuts 13, and a pair of end support portions 14.

As shown in FIGS. 5 and 10, the bundle stand 2 includes linear rails 3. In the present embodiment, the bundle stand 2 supports the intermediate supporting portions 4 and the end support portions 14 on the rails 3 such that the intermediate supporting portions 4 and the end support portions 14 can move in the insertion direction of the bundle 32 with respect to the casing 34.

As shown in FIGS. 5 and 6, the pair of intermediate supporting portions 4 has a first intermediate supporting portion 4A and a second intermediate supporting portion 4B so as to support the bundle 32 from the outer peripheral side of the bundle 32 at two locations which are separated from each other is a state where a center axis L2 of the bundle 32 is interposed therebetween. The first intermediate supporting portion 4A and the second intermediate supporting portion 4B are bilaterally symmetrical in a state of being used so as to come into contact with the outer peripheral surface 32*a* of the bundle 32. Hereinafter, the configuration of the first intermediate supporting portion 4A will be described, and descriptions of portions which are inverted structures with respect to the first intermediate supporting portion 4A in the configuration of the second intermediate supporting portion 4B will be omitted.

As shown in FIGS. 6 and 7, the first intermediate supporting portion 4A includes the traveling plate 5 which supports the bundle 32 from the outer peripheral side, a first support plate 6 and a second support plate 7 which are fixed to the traveling plate 5, and a seat plate 8 and a rib plate 9 which connect the first support plate 6 and the second support plate 7 to each other.

The traveling plate 5 is a curved plate having a curved shape following the shape of the outer peripheral surface 32*a* of the bundle 32 shown in FIGS. 2 and 3. As shown in FIGS. 5 and 6, the traveling plate 5 supports the bundle 32 before being inserting into the casing 34 in the direction of the horizontal axis L1 at a position closer to the insertion side of the bundle 32 than an end portion 32*d* (hereinafter, referred to as a "rear end portion) on a side opposite to the end portion 32*c* (hereinafter, referred to as a "distal end portion") on the insertion side of the bundle 32.

As shown in FIGS. 6 and 7, through-holes 5*a* through which screws are inserted so as to fix the traveling plates 5 and the bundle 32 are formed in the traveling plate 5. In addition, the positions, numbers, and dimensions of the through-holes 5*a* formed on the traveling plates 5 are determined so as to appropriately fix the traveling plates 5 to the attachment holes 32*b* which are formed in the bundle 32 according to the configuration (refer to FIGS. 2 and 3) of the outer peripheral surface 32*a* of the bundle 32.

As shown in FIGS. 6 and 9, the first support plate 6 is a plate-shaped member having a first through-hole 6*a* into which the traveling rod 12 is inserted. The first support plate 6 extends in a direction orthogonal to the center axis of the first through-hole 6*a* into which the traveling rod 12 is inserted. The first support plate 6 is fixed to a side opposite to the side which comes into contact with the outer peripheral surface 32*a* of the bundle 32 in the outer surface of the traveling plate 5.

The second support plate 7 is a plate-shaped member which extends to be parallel to the first support plate 6 at a position separated from the first support plate 6 in the direction of the center axis of the first through-hole 6*a* formed in the first support plate 6. A second through-hole 7*a* which is coaxial with the first through-hole 6*a* of the first support plate 6 is formed in the second support plate 7. The second through-hole 7*a* is a hole having an inner diameter into which the traveling rod 12 can be inserted.

The seat plate 8 is a plate-shaped member which is fixed to each of the first support plate 6 and the second support plate 7 by welding or the like in a state where each of the first support plate 6 and the second support plate 7 is disposed.

The moving portion 10 can be attached to the seat plate 8 by screwing or the like.

The rib plate 9 is a plate-shaped member which connects the first support plate 6 and the second support plate 7 to each other at a position separated from the seat plate 8. The rib plate 9 is a reinforcing member which prevents distortion of the first support plate 6 and the second support plate 7.

As shown in FIGS. 6 and 10, each of the moving portions 10 includes a bogie 11 which travels on the rail 3 of bundle stand 2. The bogies 11 can move the pair of intermediate supporting portions 4 and the casing 34 relative to each other in the direction of the horizontal axis L1 of the casing 34. In the present embodiment, the pair of intermediate supporting portions 4 to which the bogies 11 are attached moves with respect to the casing 34 which is in a fixed state.

In addition, the moving portions 10 further include bogies 11A which travel on the rails 3 of the bundle stand 2 so as to move the end support portions 14 and the casing relative to each other in the direction of the horizontal axis L1 of the casing 34.

In the present embodiment, since the direction of the bundle stand 2 is positioned with respect to the casing 34 such that the longitudinal direction of each of the rails 3 and the horizontal axis L1 of the casing 34 are parallel to each other, it is possible to move the pair of intermediate supporting portions 4 and the end support portions 14, and the casing 34 relative to each other in the direction of the horizontal axis L1 of the casing 34.

Each of the traveling rods 12 shown in FIGS. 5 and 9 is a threaded rod which has a distal end fixed to the fixing hole 34*b* (refer to FIG. 1) formed in the casing 34 and is inserted into the first through-hole 6*a* and the second through-hole 7*a* of each of the pair of intermediate supporting portions 4. Screw threads corresponding to screw grooves of the fixing hole 34*b* of the casing 34 are formed on the outer peripheral surface of the traveling rod 12.

As shown in FIGS. 5 and 9, nuts 13 include first nuts 13A which are attached to the traveling rods 12 so as to come into contact with the pair of intermediate supporting portions 4 from the side closer to the rear end portion 32*d* of the bundle 32 than the pair of intermediate supporting portions 4, and second nuts 13B which are attached to the traveling rods 12 so as to come into contact with the pair of intermediate supporting portions 4 from the side closer to the distal end portion 32*c* of the bundle 32 than the pair of intermediate supporting portions 4.

The first nuts 13A are used for the movement of the bundle 32 in the insertion direction of the bundle 32 with respect to the casing 34. The second nuts 13B are used for the movement of the bundle 32 in the insertion direction of the bundle 32 with respect to the casing 34. It is not indispensable that the first nuts 13A and the second nuts 13B are simultaneously attached to the traveling rods 12. For example, when the bundle 32 is inserted into the casing 34, the second nuts 13B may not be provided as long as the first nuts 13A are provided.

In addition, if the first nuts 13A and the second nuts 13B are simultaneously attached to the traveling rods 12, either the first nuts 13A or the second nuts 13B are used as desired nuts 13, and the bundle 32 can be easily inserted and removed with respect to the casing 34.

As shown in FIGS. 5 and 10, the end support portion 14 is a member which supports the rear end portion 32*d* of the bundle 32. The end support portion 14 includes a first end support portion 14A which is disposed on the same rail 3 as the rail 3 on which the first intermediate supporting portion 4A travels, and a second end support portion 14B which is disposed the same rail 3 as the rail 3 on which the second intermediate supporting portion 4B travels. Hereinafter, the configuration of the first end support portion 14A will be described, and among the configurations of the second end support portion 14B, descriptions with respect to portions common to the configuration of the first end support portion 14A will be omitted.

An end side through-hole 14*a* which is coaxial with the first through-hole 6*a* and the second through-hole 7*a* of the first intermediate supporting portion 4A is formed in the first end support portion 14A. The traveling rod 12 can be inserted into the end side through-hole 14*a*. In addition, the bogie 11A can be attached to the first end support portion 14A, and the first end support portion 14A is movable along the rail 3 of the bundle stand 2.

Figure 11:
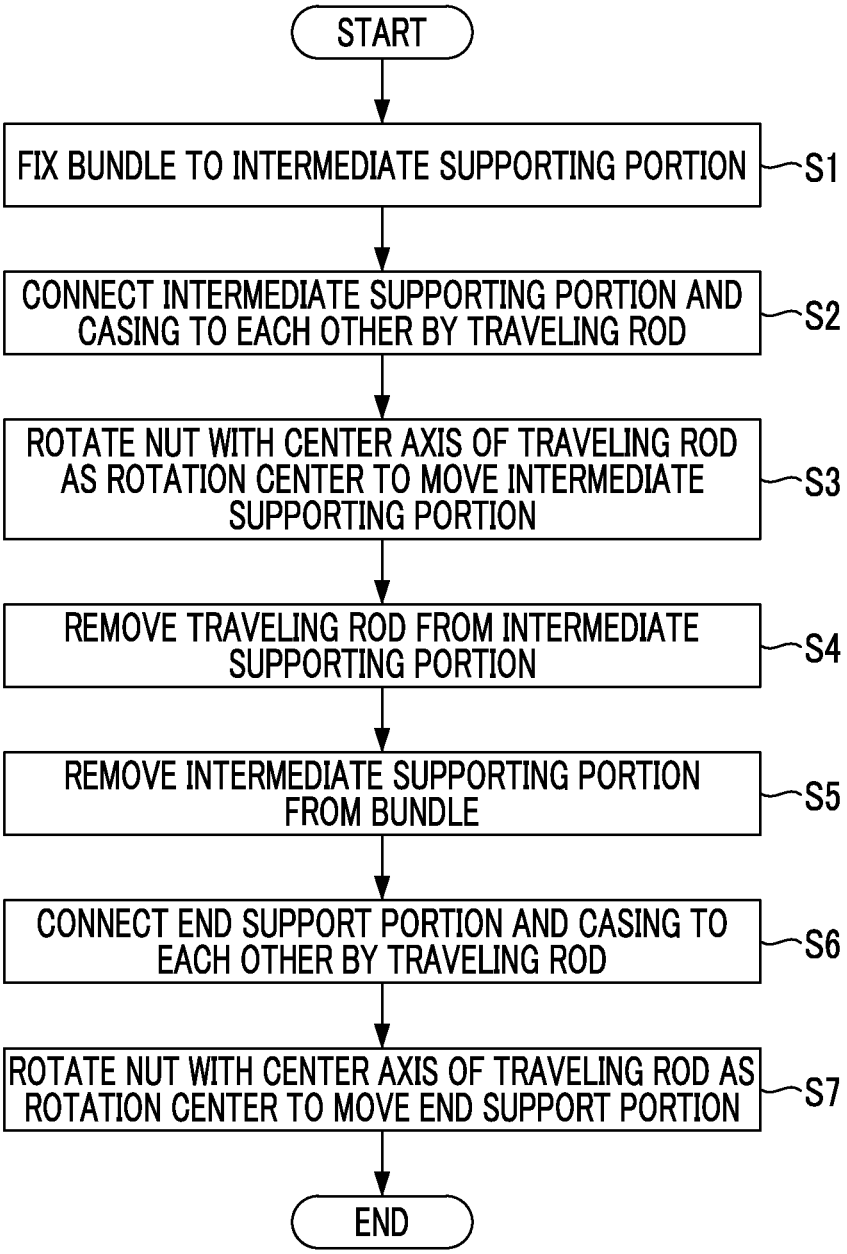
FIG. 11 is a flowchart showing a method of inserting and removing a compressor using the inserting and removing device for a compressor of the present embodiment.

Next, a method of inserting and removing a bundle using the inserting and removing device 1 of the present embodiment will be described along with effects of the inserting and removing device 1. FIG. 11 is a flowchart showing a method of inserting and removing a compressor using an inserting and removing device for a compressor of the present embodiment. FIGS. 12 to 18 are explanatory views for explaining an insertion step of a compressor using the inserting and removing device for a compressor of the present embodiment.

Figure 12:
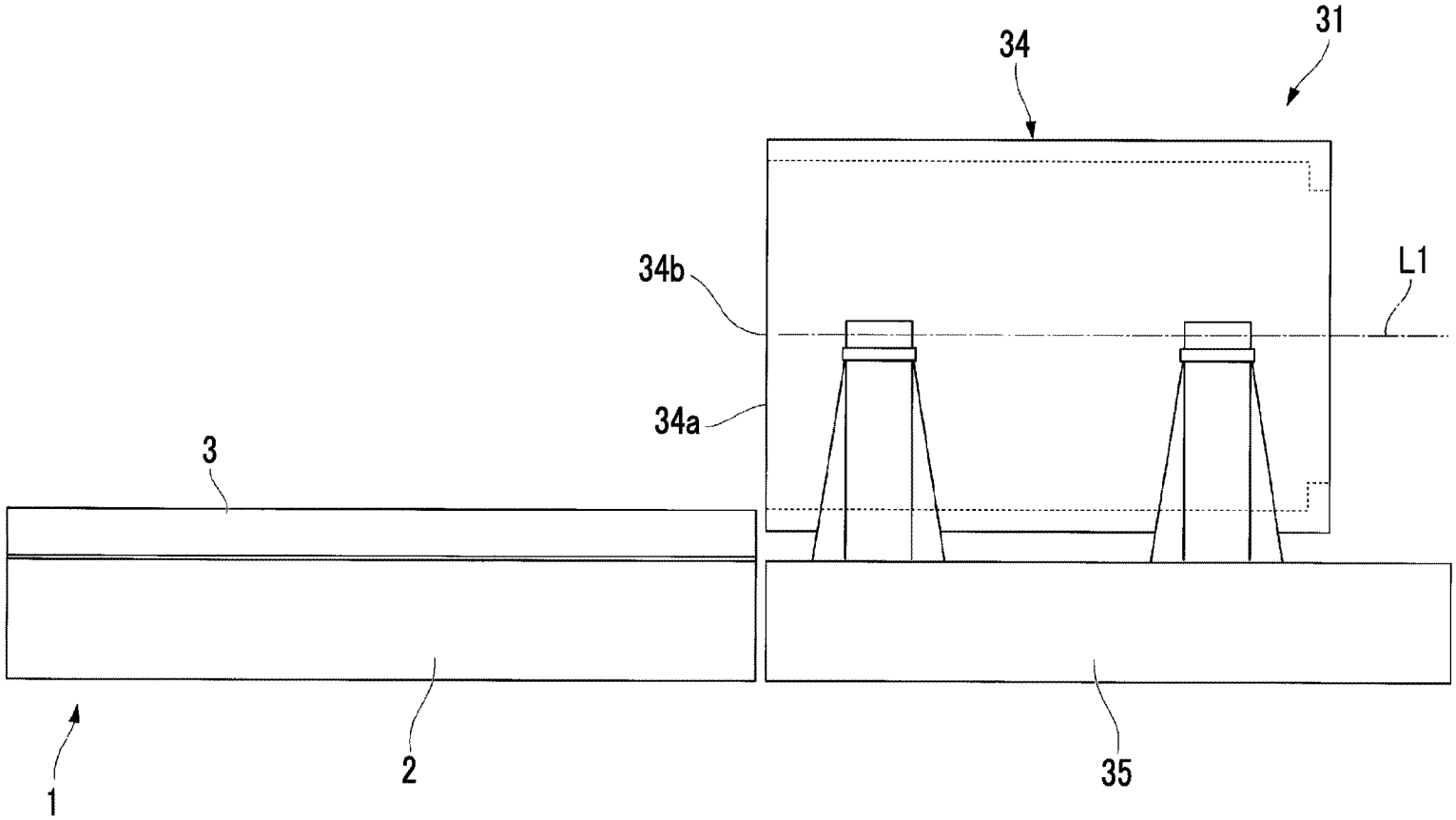
FIG. 12 is an explanatory view for explaining an insertion step of a compressor using the inserting and removing device for a compressor of the present embodiment.
Figure 13:
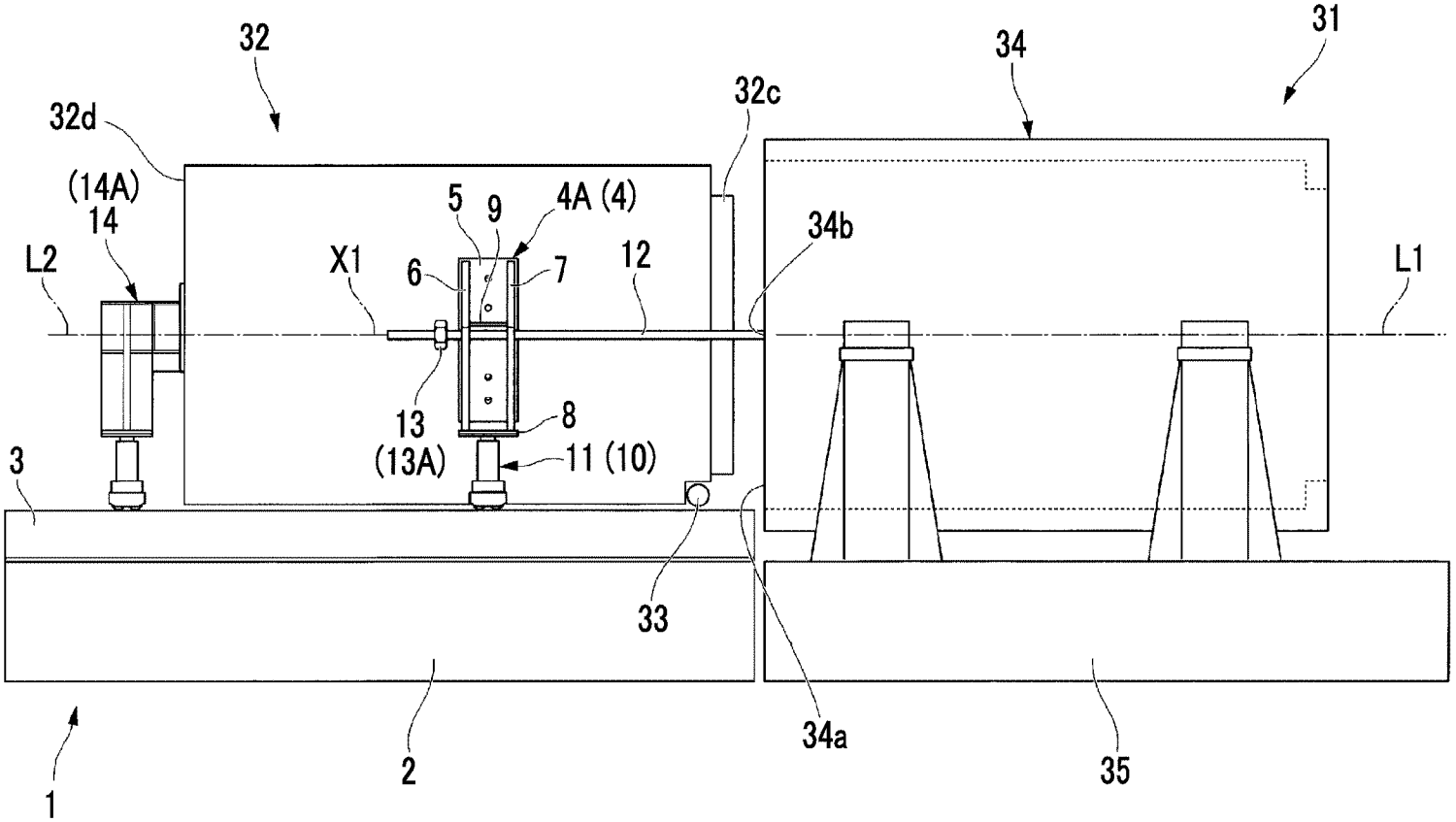
FIG. 13 is an explanatory view for explaining the insertion step of a compressor using the inserting and removing device for a compressor of the present embodiment.

First, an installation worker transports the bundle stand 2 for placing the bundle 32 to an opening which is formed on the end surface 34*a* on the insertion side of the casing 34 (refer to FIG. 12).

Next, the bundle 32 is placed on the bundle stand 2 using a known crane or the like. In addition, the pair of intermediate supporting portions 4 and the pair of end support portions 14 are attached to the bundle 32 (Step S1 shown in FIG. 11 and refer to FIG. 13). The pair of intermediate supporting portions 4 and the end support portions 14 travel on the rails 3 of the bundle stand 2 by the bogies 11, and the bundle 32 can move in the direction of the horizontal axis L1 of the casing 34.

Continuously, the installation worker attaches the traveling rods 12 and the first nuts 13A to the pair of intermediate supporting portions 4 disposed on the rails 3 of the bundle stand 2, and the installation worker screws the distal ends 12*a* of the traveling rods 12 to the fixing holes 34*b* of the casing 34 to fix the distal end 12*a* to the fixing hole 34*b*. When the bundle 32 moves in the casing 34, the first nuts 13A are attached to the side closer to the rear end portion 32*d* of the bundle 32 than the pair of intermediate supporting portions 4 (Step S2 shown in FIG. 11 and refer to FIG. 13).

Subsequently, the installation worker rotates the first nuts 13A around the center axes X1 of the traveling rods 12 (Step S3 shown in FIG. 11 and refer to FIG. 14), and when the bundle 32 moves in the casing 34, the installation worker rotates the first nuts 13A around the center axes X1 of the traveling rod 12 so as to move the first nuts 13A toward the casing 34 side. The first nuts 13A which move toward the casing 34 in the direction of the center axis X1 of the traveling rod 12 abut on the second support plates 7 of the pair of intermediate supporting portions 4. If the installation worker further rotates the first nut 13A so as to move the first nut 13A toward the casing 34 side from the state where the first nut 13A abuts on the second support plate 7, the first nut 13A moves the pair of intermediate supporting portions 4 toward the casing 34 side along the rails 3. The bundle 32 fixed to the pair of intermediate supporting portions 4 and the pair of end support portions 14 fixed to the bundle 32 move toward the casing 34 according to the rotations of the first nuts 13A integrally with the pair of intermediate supporting portions 4.

Figure 14:
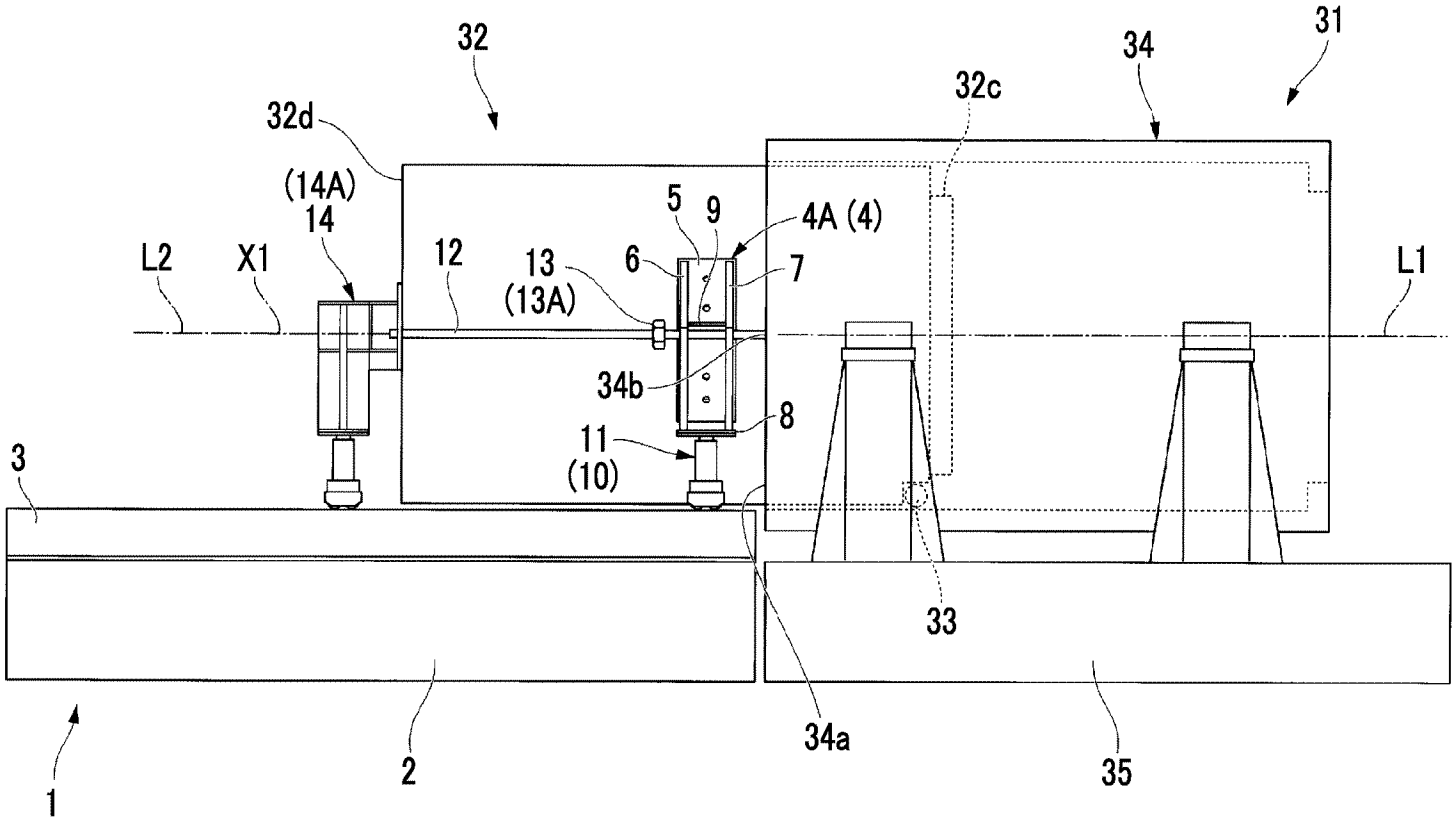
FIG. 14 is an explanatory view for explaining the insertion step of a compressor using the inserting and removing device for a compressor of the present embodiment.

Since the center axis L2 of the bundle 32 is approximately coaxial with the horizontal axis L1 of the casing 34, the bundle 32 is inserted from the distal end portion 32*c* into the casing 34 as shown in FIG. 14.

If the pair of intermediate supporting portions 4 reaches a position close to the casing 34, the installation worker removes the traveling rods 12 from the casing 34, and the installation worker removes the first nuts 13A from the traveling rods 12 (Step S4 shown in FIG. 11). Subsequently, the installation worker removes the pair of intermediate supporting portions 4 from the bundle 32 (Step S5 shown in FIG. 11). The removal of the pair of intermediate supporting portions 4 is performed by lifting the pair of intermediate supporting portions 4 from the rails 3 by a known crane after the screwing between the traveling plates 5 and the bundle is removed. In addition, in the course of the pair of intermediate supporting portions 4 reaching the position close to the casing 34, the traveling rods 12 may enter the end side through-holes 14*a* of the pair of end support portions 14. In this case, the installation worker extracts the traveling rods 12 from the first through-hole 6*a* and the second through-hole 7*a* of the pair of intermediate supporting portions 4 and the end side through-holes 14*a* of the pair of end support portions 14.

After the pair of intermediate supporting portions 4 is removed from the bundle 32, the bundle 32 is supported by the casing 34 and the pair of end support portions 14. In this state, the installation worker fixes the traveling rods 12 to the fixing holes 34*b* of the casing 34 again, and the traveling rods 12 are inserted into the end side through-hole 14*a* of the pair of the end support portions 14 (Step S6 shown in FIG. 11 and refer to FIG. 15). The first nuts 13A are attached to the traveling rods 12 from rear end 12*b* sides of the traveling rods 12.

Figure 15:
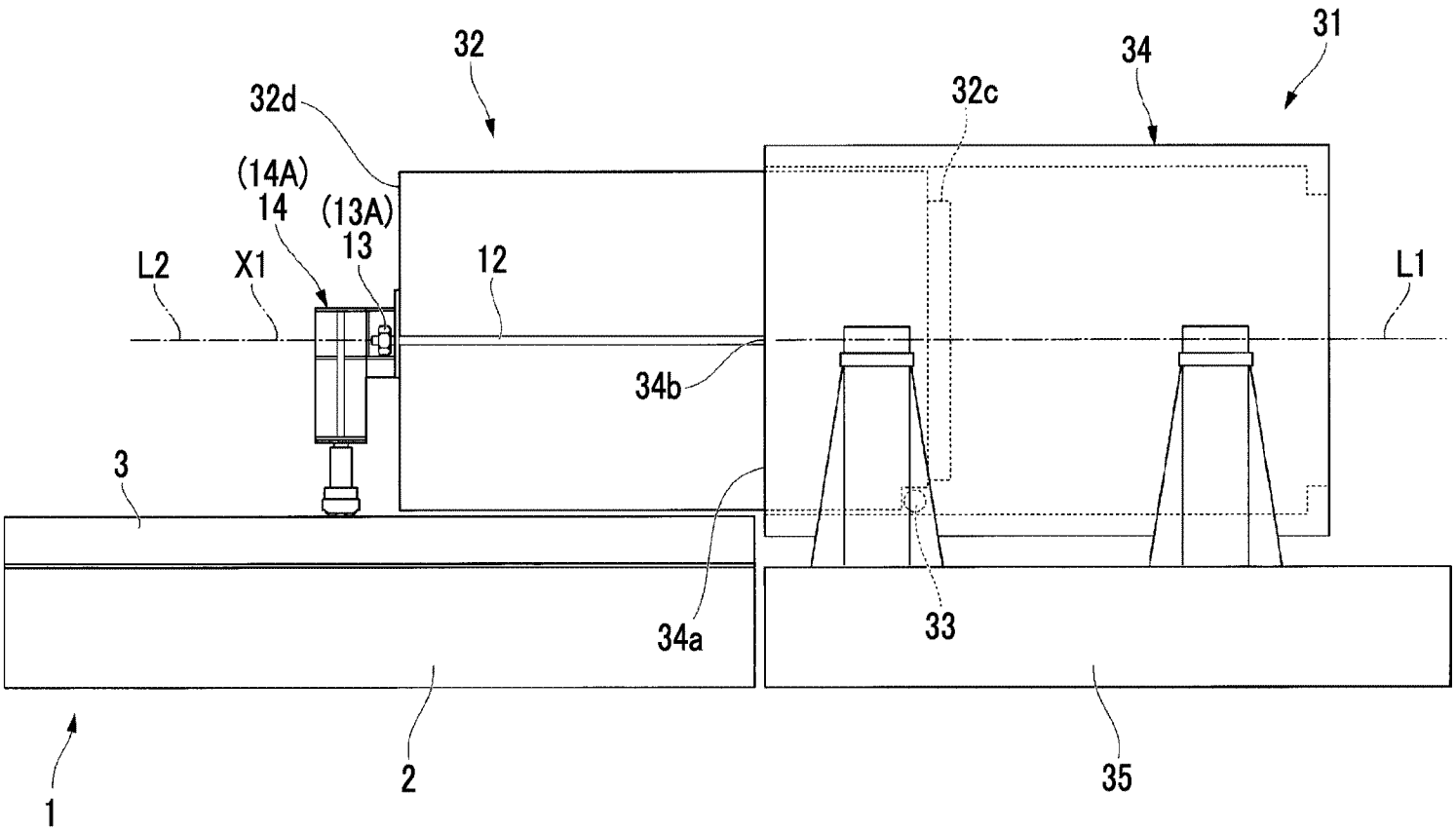
FIG. 15 is an explanatory view for explaining the insertion step of a compressor using the inserting and removing device for a compressor of the present embodiment.
Figure 16:
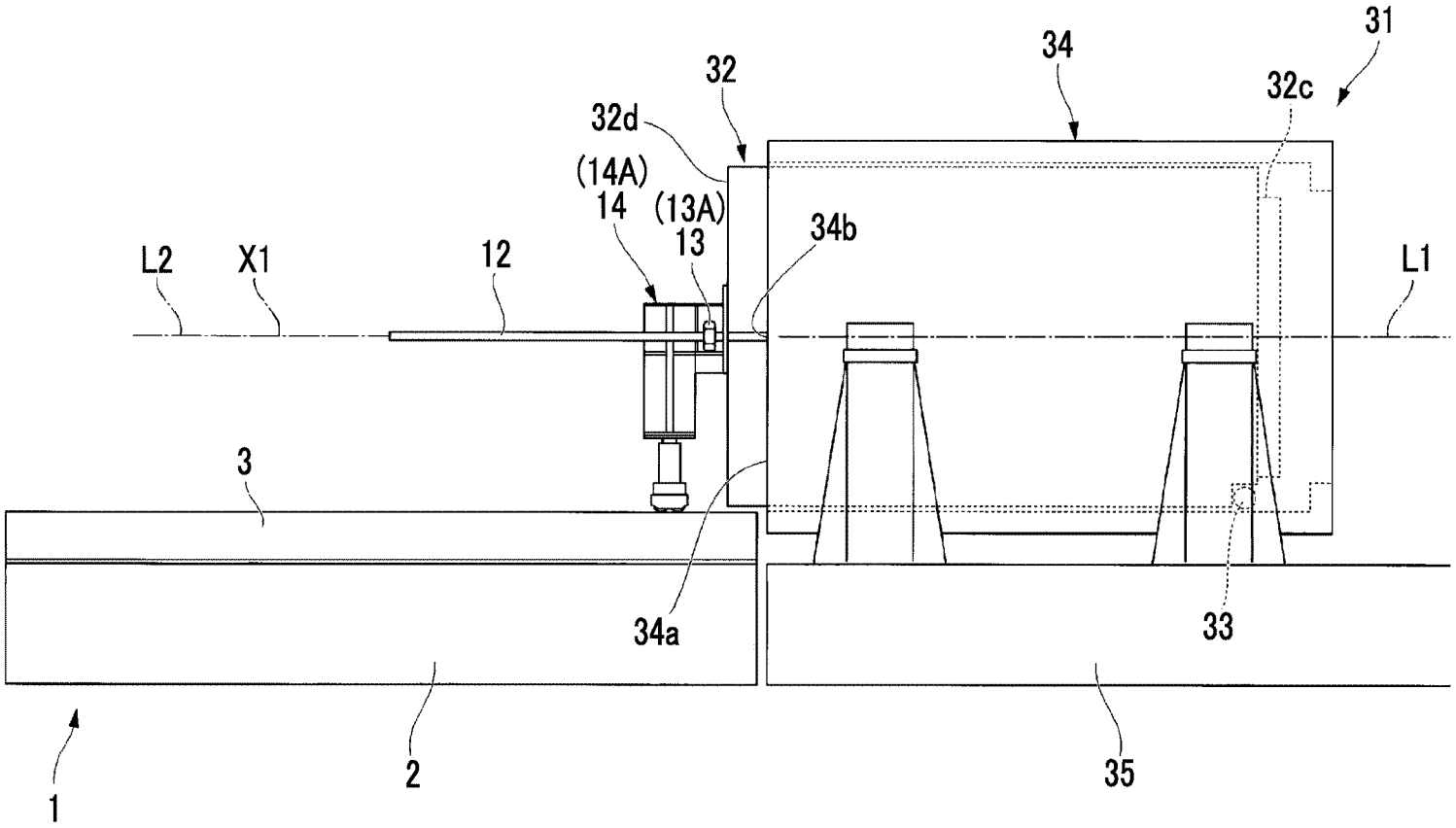
FIG. 16 is an explanatory view for explaining the insertion step of a compressor using the inserting and removing device for a compressor of the present embodiment.
Figure 17:
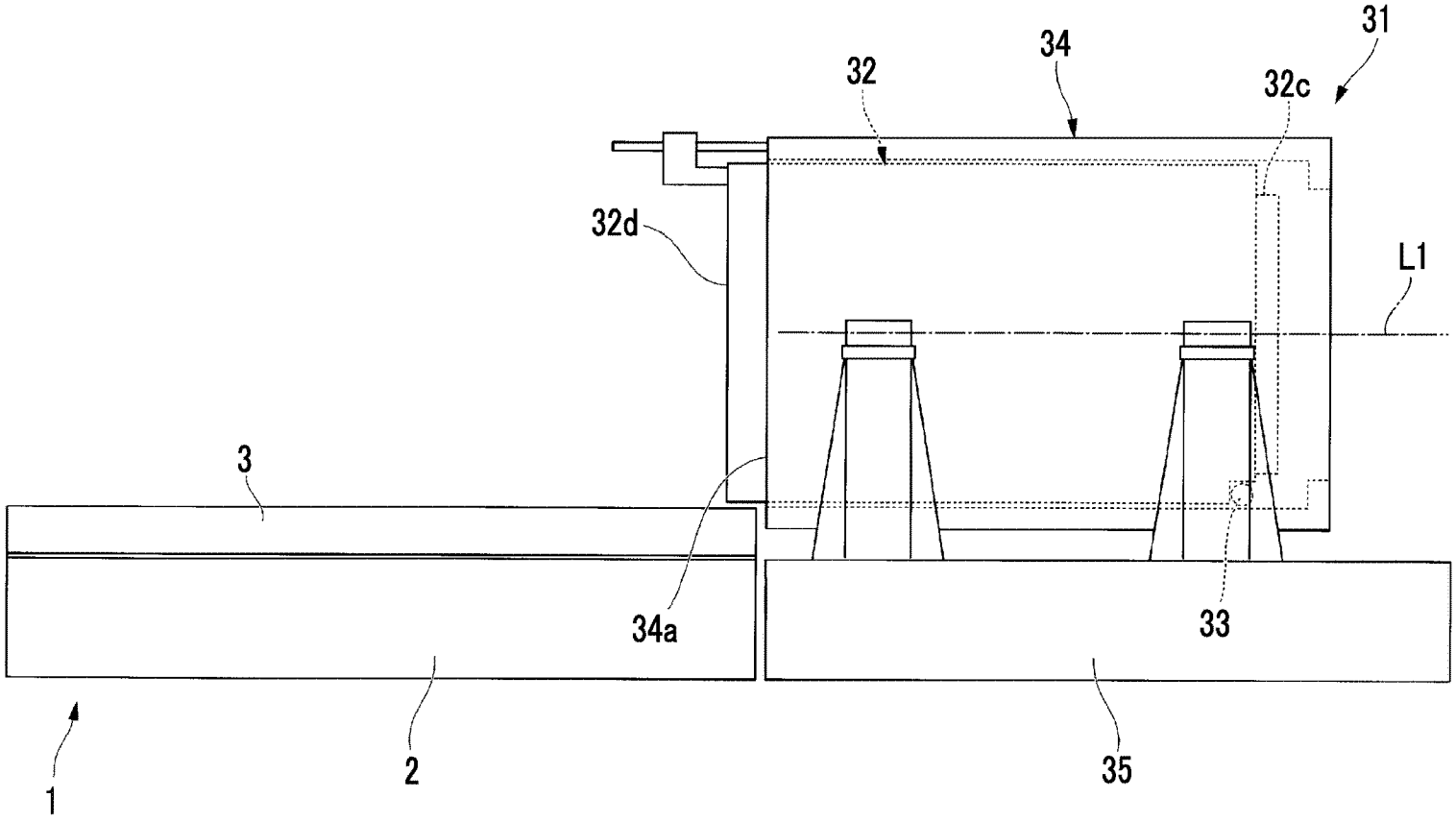
FIG. 17 is an explanatory view for explaining the insertion step of a compressor using the inserting and removing device for a compressor of the present embodiment.

After the installation worker attaches each of the first nuts 13A to the rear end 12*b* (refer to FIG. 9) of the traveling rod 12, the installation worker rotates the first nut 13A around the center axis X1 of the traveling rod 12 so as to move the first nut 13A toward the casing 34 side (Step S7 shown in FIG. 11). The first nuts 13A move toward the casing 34 side in the directions of the center axes X1 of the traveling rods 12 and abut on the pair of end support portions 14. If the installation worker further rotates the first nuts 13A so as to move the first nuts 13A toward the casing 34 side from the state where the first nuts 13A abut on the pair of end support portions 14, the first nuts 13A move the pair of end support portions 14 toward the casing 34 side along the rails 3. As shown in FIGS. 15 and 16, the bundle 32 fixed to the pair of end support portions 14 moves toward the casing 34 according to the rotations of the first nuts 13A integrally with the pair of end support portions 14. Since the pair of end support portions 14 move toward the casing 34 side by the first nuts 13A, the bundle 32 reaches a specified attachment position inside the casing 34. If necessary, as shown in FIG. 17, the bundle 32 may be pushed into the casing 34 using a known puller.

Figure 18:
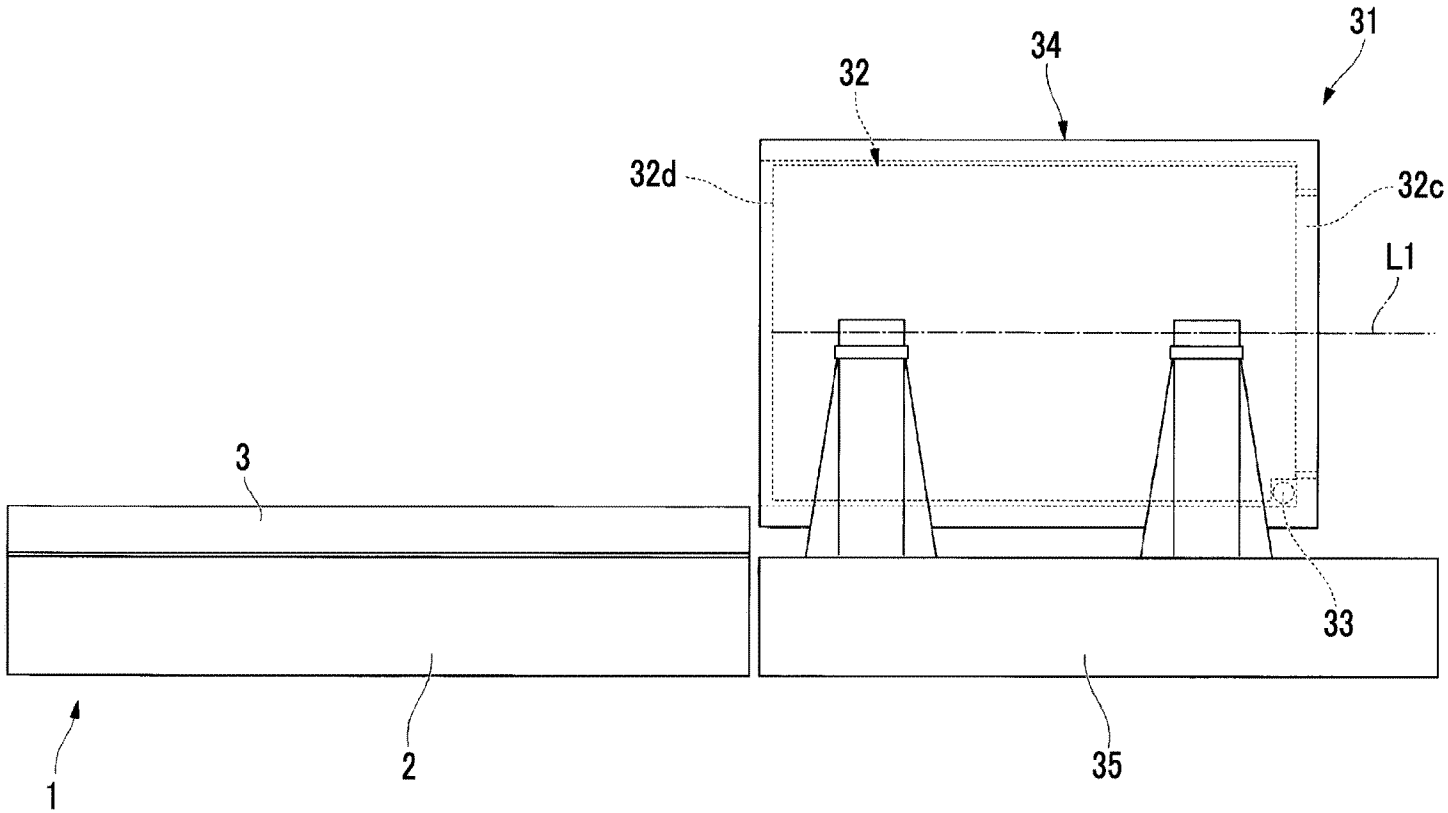
FIG. 18 is an explanatory view for explaining the insertion step of a compressor using the inserting and removing device for a compressor of the present embodiment.

As shown in FIG. 18, if the bundle 32 reaches the specified installation position inside the casing 34, the pair of end support portions 14 are removed from the bundle 32, and the traveling rods 12 are removed from the casing 34.

Accordingly, the insertion operation of the bundle 32 with respect to the casing 34 ends.

When the bundle 32 is extracted from the casing 34, although it is not shown in detail, the procedure is approximately opposite to that of the insertion operation.

First, the installation worker positions the bundle stand 2 on the opening side of the casing 34 and fixes the pair of end support portions 14 to the bundle 32, and the installation worker connects the end support portions 14 and the casing 34 to each other by traveling rods 12 in a state where the second nuts 13B are positioned between the end support portions 14 and the casing 34.

The installation worker rotates the second nuts 13B around the center axes X1 of the traveling rods 12 such that the second nuts 13B move toward the rear end 12*b* sides of the traveling rods 12, the second nuts 13B press the pair of end support portions 14, and the bundle 32 fixed to the end support portions 14 is pulled out from the casing 34.

If the attachment holes 32*b* formed on the outer peripheral surface 32*a* of the bundle 32 are exposed to the outside of the casing 34 in a state where the side rollers 33 are positioned inside the casing 34, the installation worker temporarily removes the traveling rods 12 from the pair of end support portions 14 and the casing 34, attaches the pair of intermediate supporting portions 4 to the attachment holes 32*b*, and disposes the pair of intermediate supporting portions 4 on the rails 3 of the bundle stand 2.

After the installation worker disposes the pair of intermediate supporting portions 4 on the rails 3 of the bundle stand 2, the installation worker attaches the traveling rods 12 to the pair of intermediate supporting portions 4 and the casing 34 again, and the installation worker rotates the second nuts 13B around the center axis X1 of the traveling rod 12 such that the second nuts 13B move toward the rear end 12*b* sides of the traveling rods 12. Since the second nuts 13B rotate around the center axes X1 of the traveling rods 12, the pair of intermediate supporting portions 4 is pressed using the second nuts 13B, and the bundle 32 fixed to the pair of intermediate supporting portions 4 is completely extracted outside from the casing 34.

As described above, according to the inserting and removing device and the inserting and removing method of the present embodiment, it is possible to move the bundle 32 with respect to the casing 34 from the state where the bundle 32 completely comes out from the casing 34 to the state where the bundle 32 is installed at the specified position inside the casing 34 by traveling rods 12 which are shorter than the entire length of the bundle in the direction of the center axis of the bundle. Accordingly, a working space required for inserting and removing the bundle 32 with respect to the casing 34 does not largely protrude from the space occupied by the bundle 32. As a result, if there is a working space enough to arrange the casing 34 and the bundle 32 in the direction of the horizontal axis L1 of the casing 34, it is possible to insert and remove the bundle 32 with respect to the casing 34.

In addition, since the first through-holes 6*a* and the second through-hole 7*a* of the pair of intermediate supporting portions 4 and the end side through-holes 14*a* of the end support portion 14 are coaxial with each other, the fixing holes 34*b* for fixing the distal ends 12*a* of the traveling rods 12 can be used for both the connections between the pair of intermediate supporting portions 4 and the traveling rods 12 and the connections between the end support portions 14 and the traveling rods 12.

In addition, since each of the pair of intermediate supporting portions 4 has the first support plate 6, the second support plate 7, the rib plate 9, and the seat plate 8 and deformation of the first support plate 6 and the second support plate 7 due to the pressing forces generated by the first nut 13A and the second nut 13B is prevented by the rib plate 9 and the seat plate 8, the weight of the pair of intermediate supporting portions 4 is reduced and rigidities thereof increase.

MODIFICATION EXAMPLE

Figure 19:
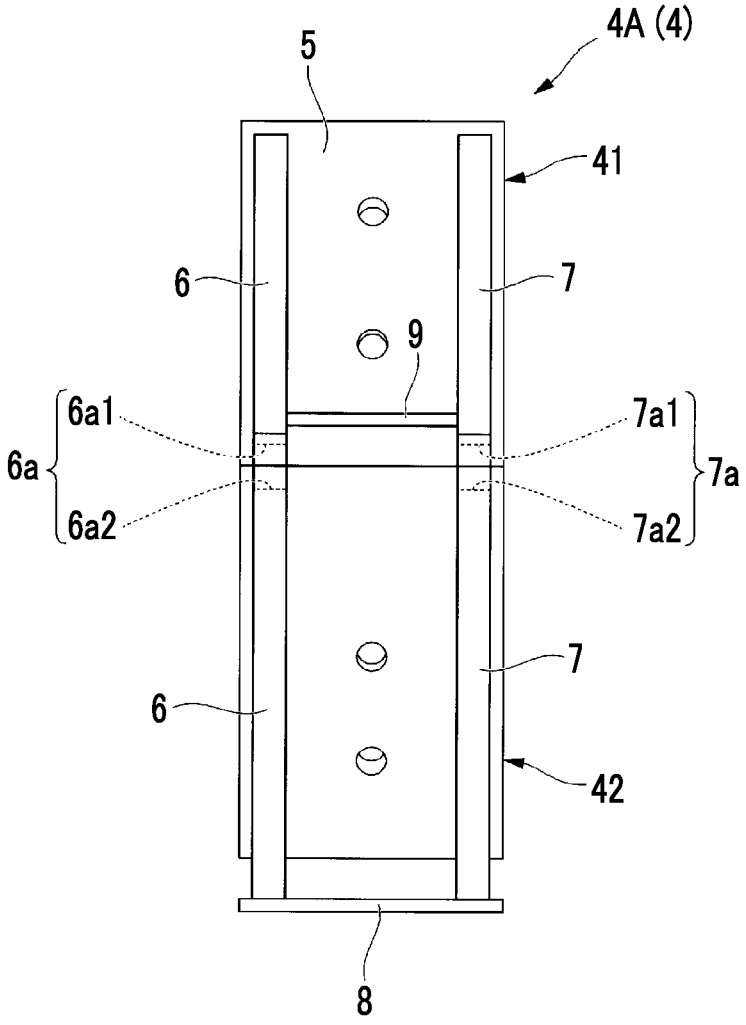
FIG. 19 is a side view showing an intermediate supporting portion of a modification example of the embodiment.
Figure 20:
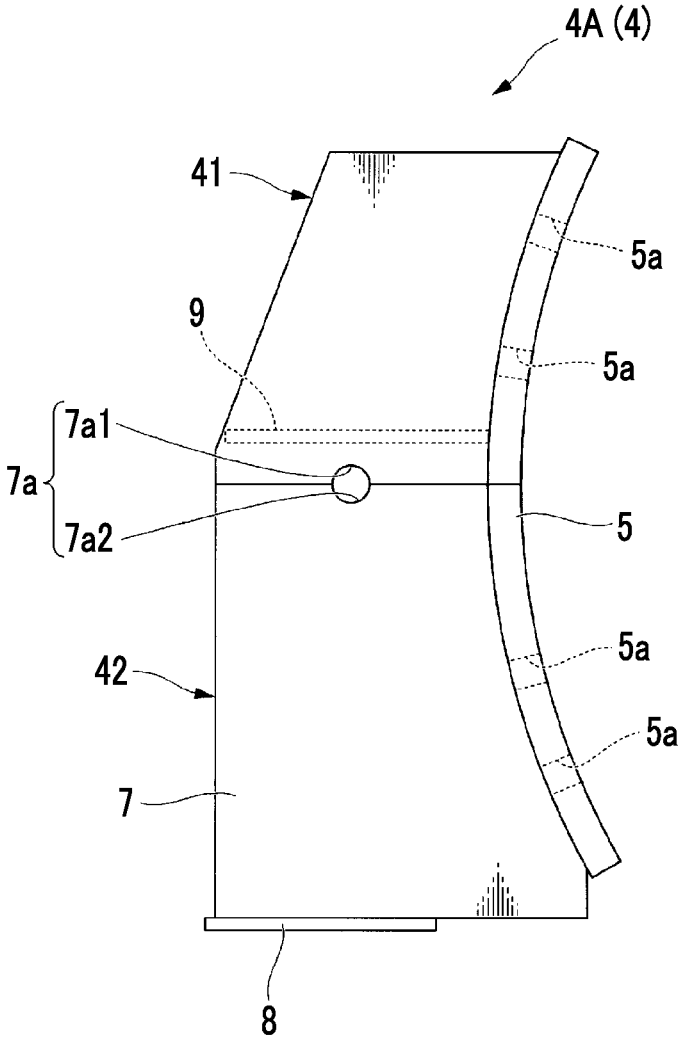
FIG. 20 is a front view showing the intermediate supporting portion of a modification example of the present embodiment.

Next, a modification example of the above-described embodiment will be described. FIG. 19 is a side view showing an intermediate supporting portion of the present modification example. FIG. 20 is a front view showing the intermediate supporting portion of the present modification example.

As shown in FIGS. 19 and 20, in the present embodiment, each of the pair of intermediate supporting portions 4 includes a first piece 41 and a second piece 42 which can be separated from each other so as to divide each of the first through-hole 6*a* and the second through-hole 7*a* into two.

The first piece 41 and the second piece 42 include semi-cylindrical depressions 6*a*1 and 6*a*2 which are combined to each other so as to be first through-hole 6*a*, and semi-cylindrical depressions 7*a*1 and 7*a*2 which are combined to each other to be the second through-hole 7*a*.

In a state where the first piece 41 and the second piece 42 are combined to each other, the first through-hole 6*a* and the second through-hole 7*a* becomes the hole into which the traveling rod 12 is inserted, and in a state where the first piece 41 and the second piece 42 are separated from each other, each of the first through-hole 6*a* and the second through-hole 7*a* is divided into two in a state of having the semi-cylindrical depression 6*a*1 and the semi-cylindrical depression 7*a*1 in the first piece 41 and the semi-cylindrical depression 6*a*2 and the semi-cylindrical depression 7*a*2 in the second piece 42.

In the present modification example, since the first piece 41 and the second piece 42 are separated from each other in the state where the traveling rod 12 is inserted into the first through-hole 6*a* and the second through-hole 7*a* shown in FIG. 19 similarly to FIG. 9, it is possible to remove the traveling rod 12 from the first through-hole 6*a* and the second through-hole 7*a* without extracting the traveling rod 12 by moving the traveling rod 12 in the direction of the center axis of the first through-hole 6*a* and the second through-hole 7*a*. Accordingly, the removal work of the pair of intermediate supporting portions 4 from the bundle 32 is simple. In addition, if the traveling rods 12 are inserted into the end side through-holes 14*a* of the pair of end support portions 14 when the pair of intermediate supporting portions 4 are positioned to be close to the casing 34, by attaching nuts different from the first nuts 13A for moving the pair of intermediate supporting portions 4 from the rear ends 12*b* of the traveling rod 12 so as to be used to move the pair of end support portions 14, it is possible to transfer the movement of the bundle 32 using the pair of intermediate supporting portions 4 to the movement of the bundle 32 using the end support portions 14 without removing the traveling rods 12 from the casing 34.

Hereinbefore, the embodiment of the present invention is described in detail with reference to the drawings. However, the specific configurations are not limited to the embodiment, and design modifications or the like within a scope which does not depart from the gist of the present invention are included in the present invention.

For example, instead of the configuration disclosed in the modification example of the embodiment in which each of the first through-hole 6*a* and the second through-hole 7*a* can be divided into two by the first piece 41 and the second piece 42, a side path extending in a direction intersecting the center axis of each of the first through-hole 6*a* and the second through-hole 7*a* may be provided in each of the first through-hole 6*a* and the second through-hole 7*a* such that the insertion and removal directions of the traveling rod 12 with respect to the first through-hole 6*a* and the second through-hole 7*a* coincide with the movement directions when the pair of intermediate supporting portions 4 is attached to and detached from the bundle stand 2. In this case, although the attachment and detachment directions of the pair of intermediate supporting portions 4 with respect to the bundle stand 2 are limited, it is unnecessary to divide the pair of intermediate supporting portions 4.

INDUSTRIAL APPLICABILITY

The present invention can be used in a jig for moving a heavy article in a narrow space.

REFERENCE SIGNS LIST

1: inserting and removing device
2: bundle stand
3: rail
4: pair of intermediate supporting portions
5: traveling plate
6: first support plate
7: second support plate
8: seat plate
9: rib plate
10: moving portion
11, 11A: bogie
12: traveling rod
13: nut
14: end support portion
31: compressor
32: bundle
34: compressor casing
35: casing stand

The invention claimed is:

1. An inserting and removing device for a compressor, comprising:

an intermediate supporting portion which supports a bundle before being inserted into a compressor casing formed in a tubular shape about a horizontal axis in a direction of the horizontal axis, from an outer peripheral side of the bundle at a position closer to an insertion side than an end portion on a side opposite to the insertion side of the bundle;

a moving portion which can move the intermediate supporting portion and the compressor casing relative to each other in the direction of the horizontal axis;

a threaded rod which extends to be parallel to the horizontal axis, has a distal end fixed to a fixing hole formed on an end surface on the insertion side of the compressor casing, and is inserted into a through-hole formed in the intermediate supporting portion; and a nut which is attached to the threaded rod so as to come into contact with the intermediate supporting portion from a side closer to the end portion of the bundle than the intermediate supporting portion.

2. This inserting and removing device for a compressor according to claim 1, further comprising:

an end support portion which has a through-hole which is coaxially formed with the through-hole of the intermediate supporting portion and into which the threaded rod can be inserted, and supports the end portion.

3. The inserting and removing device for a compressor according to claim 1, wherein the intermediate supporting portion includes a curved plate which is formed in a curved shape following a shape of an outer periphery of the bundle, a first support plate which includes the through-hole, extends in a direction orthogonal to a center axis of the through-hole, and is fixed to the curved plate, a second support plate which extends to be parallel to the first support plate at a position separated from the first support plate in the direction of the center axis of the through-hole, and has a second through-hole which is coaxially formed with the through-hole and into which the threaded rod can be inserted, a seat plate which connects the first support plate and the second support plate to each other, and a rib plate which connects the first support plate and the second support plate at a position separated from the seat plate.

4. A method of inserting and removing a bundle, comprising:

a step of connecting a position of an outer peripheral surface of a bundle closer to an insertion side of a bundle inserted into a compressor casing than an end portion on a side opposite to the insertion side and the compressor casing to each other by an intermediate supporting portion which supports the bundle and a threaded rod which is inserted into the intermediate supporting portion, extends in an insertion direction of the bundle with respect to the compressor casing, and can be fixed to the compressor casing; and a step of moving the bundle and the compressor casing relative to each other in the insertion direction by rotating a nut screwed to the threaded rod around a center axis of the threaded rod in a state where the nut abuts on the intermediate supporting portion.

* * * * *